US011719401B1

(12) United States Patent
Chen

(10) Patent No.: US 11,719,401 B1
(45) Date of Patent: Aug. 8, 2023

(54) LED CANDLE FLAME LIGHT

(71) Applicant: Sikai Chen, Delran, NJ (US)

(72) Inventor: Sikai Chen, Delran, NJ (US)

( * ) Notice: Subject to any disclaimer, the term of this patent is extended or adjusted under 35 U.S.C. 154(b) by 0 days.

(21) Appl. No.: 18/062,136

(22) Filed: Dec. 6, 2022

(51) Int. Cl.

| | |
|---|---|
| ***F21S 10/04*** | (2006.01) |
| ***F21V 17/04*** | (2006.01) |
| ***F21V 29/70*** | (2015.01) |
| ***F21K 9/235*** | (2016.01) |
| ***F21V 3/02*** | (2006.01) |
| ***F21Y 115/10*** | (2016.01) |

(52) U.S. Cl.
CPC ..... *F21S 10/04* (2013.01); *F21K 9/235* (2016.08); *F21V 3/02* (2013.01); *F21V 17/04* (2013.01); *F21V 29/70* (2015.01); *F21Y 2115/10* (2016.08)

(58) Field of Classification Search
CPC .. F21S 10/04; F21K 9/235; F21V 3/02; F21V 17/04; F21V 29/70; F21Y 2115/10
See application file for complete search history.

(56) References Cited

U.S. PATENT DOCUMENTS

| | | | | |
|---|---|---|---|---|
| 9,133,988 | B2 * | 9/2015 | Coleiny | F21K 9/61 |
| 2010/0207509 | A1 * | 8/2010 | Deng | F21K 9/232 313/483 |

FOREIGN PATENT DOCUMENTS

| | | | | |
|---|---|---|---|---|
| WO | WO-2018010992 | A1 * | 1/2018 | F21K 9/232 |
| WO | WO-2022015443 | A1 * | 1/2022 | F21K 9/232 |

* cited by examiner

*Primary Examiner* — Peggy A Neils
(74) *Attorney, Agent, or Firm* — Stuart M Goldstein

(57) ABSTRACT

An LED candle flame light has a base member and an LED candle flame light filament component which extends upwardly therefrom. An inner transparent cover having the same outline shape of the filament is formfitted around the filament and encases it. An outer transparent cover encloses the inner cover. A heat sink member has an upper section and a lower section having a heat sink component fabricated of heat absorbent material. The heat sink component is configured to absorb heat generated by the filament. The component is threadably engaged to the base member such that it is adjacent to the base member, allowing it to absorb heat generated by the filament components. The outer covers can be of different shapes and are interchangeably attached to the base member.

10 Claims, 6 Drawing Sheets

LED CANDLE FLAME LIGHT

FIELD OF THE INVENTION

The present invention generally relates to electric LED lights, and, in particular, chip on board (COB) LED strip lights, which simulate the appearance of a candle flames.

BACKGROUND OF THE INVENTION

LED electrical candle flame lights, bulbs, and lamps provide the beneficial effect of simulating a candle flame, without the need for an actual hot, fiery flame. These benefits are clearly present with regard to COB LED strip lights. As a result, such lighting eliminates the danger presented by a burning flame and, in most cases, does not have the limited lighting effect of a burning candle. And simulated electric flame lights obviously have the capability of lasting much longer.

However, current candle flame lights and those in COB strip lights do have significant disadvantages. For instance, the internal filaments of current flame lights are flexile and pliant, which cause them to form misshaped appearances when they are illuminated. The filaments also generate heat which results in their transparent glass covers getting hot; thus, presenting a safety hazard. The fact that heat is generated, also limits the light's wattage capacity. The higher the wattage, the more heat. In addition, current covers do not adequately protect their internal filaments from damage caused by impacts to the covers of the light. Significantly, the covers of present candle flame lights are fabricated of a given shape. If candle flame lights of multiple shapes are desired, each differently shaped light must be purchased separately.

SUMMARY OF THE INVENTION

It is thus the object of the present invention to provide an LED candle flame light for COB LED strip lights and similar lights which overcomes the disadvantages and limitations of existing flame lights.

These and other objects are accomplished by the present invention, an LED candle flame light having a base member, an opening extending up from the base member and a sidewall having inner and outer surfaces, the sidewall circumscribing the opening. A first set of screw threads extend from the inner surface of the sidewall and a second set of through threads extend from the outer surface of the sidewall. An LED candle flame light filament extends upwardly from the base member. An inner transparent cover which is formfitted to outline the shape of the filament encloses the filament. An outer second transparent cover encloses the inner cover. The outer cover has a bottom base with screw threads configured to threadably engage the first set of screw threads of the base member of the inner cover. A heat sink member has an upper section with screw threads and a lower section comprising a heat sink component fabricated of heat absorbent material. The heat sink component is configured to absorb heat generated by the filament. The screw threads of the heat sink member threadably engage the second set of threads of the base member such that the upper section of the heat sink member is located within the opening of the base member and the heat sink component is adjacent to the base member.

By this invention, the filament is caused to maintain its shape within the inner cover when the filament is illuminated. In addition, heat is absorbed and dissipated through the heat sink member, thus permitting the candle flame light to illuminate without overheating. The outer transparent cover provides both added protection from the heat generated within the inner cover and protection of the filament from being damaged by impact to the outer cover. The manner of attachment of the outer cover to the inner cover provides for versatility and interchangeability using differently shaped outer covers while using the same inner cover and its base member.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
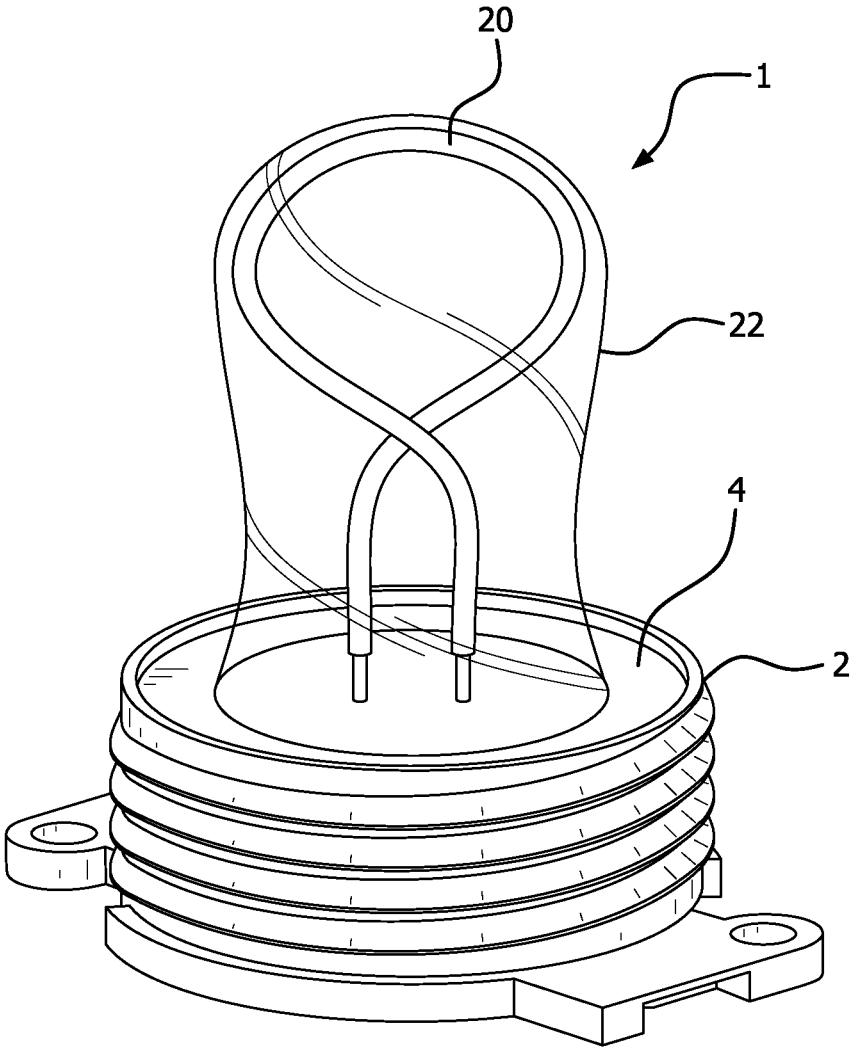
FIG. 1 shows the base member, filament and inner transparent cover of the LED candle flame light of the present invention.

LED candle flame light 1 of the present invention comprises base member 2 having top surface 4, opening 6 extending upward from bottom 8 of the base member towards the top surface. Sidewall 10 circumscribes opening 6. A first set of screw threads 16 extends from sidewall 6 and a second set of screw threads 18 extends from the sidewall. LED candle flame light filament 20 extends upwardly from top surface 4 of base member 2.

Figure 2:
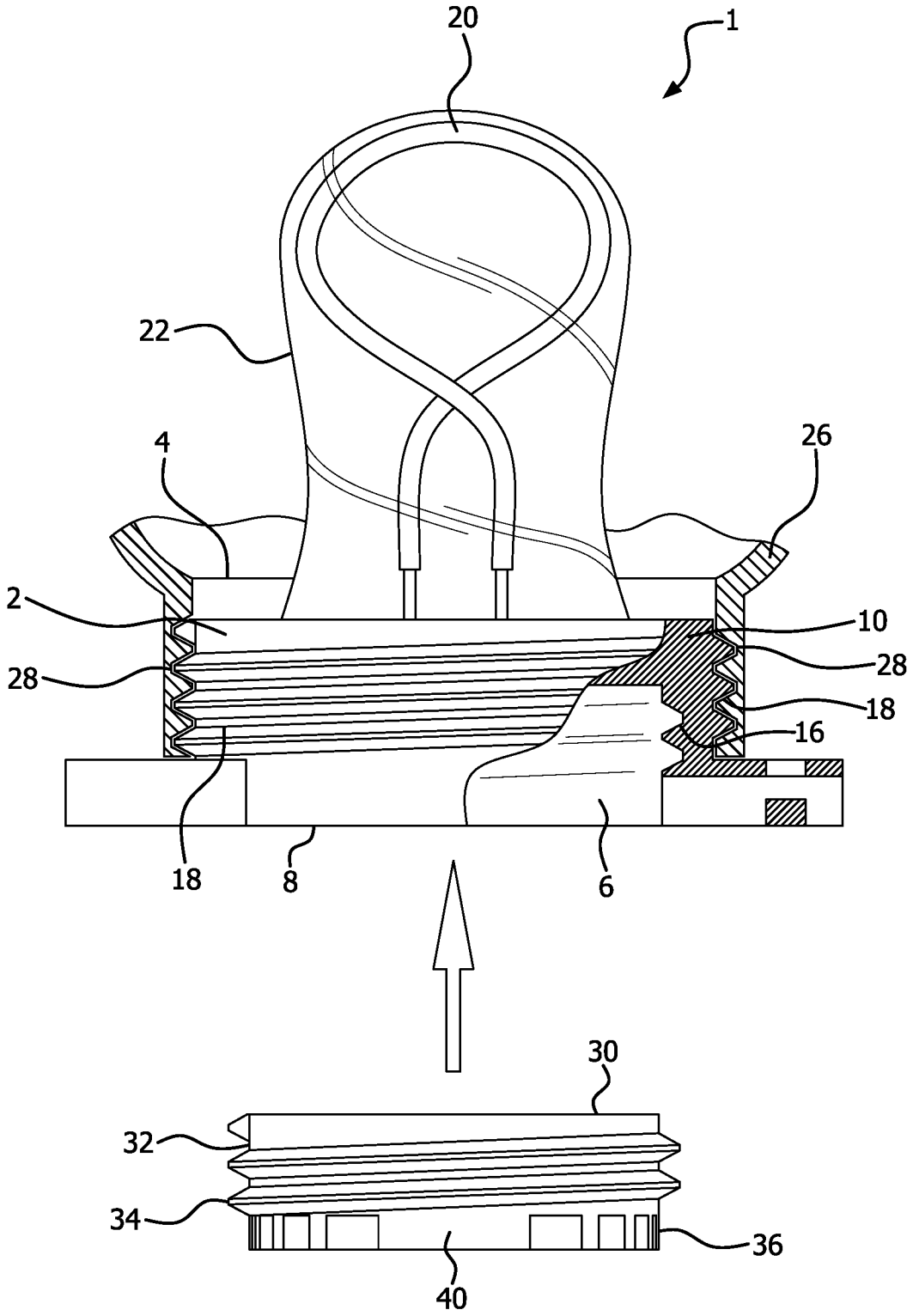
FIG. 2 illustrates a manner of attachment of the heat sink member with the base member of the inner cover of the LED candle flame light of the present invention.
Figure 3:
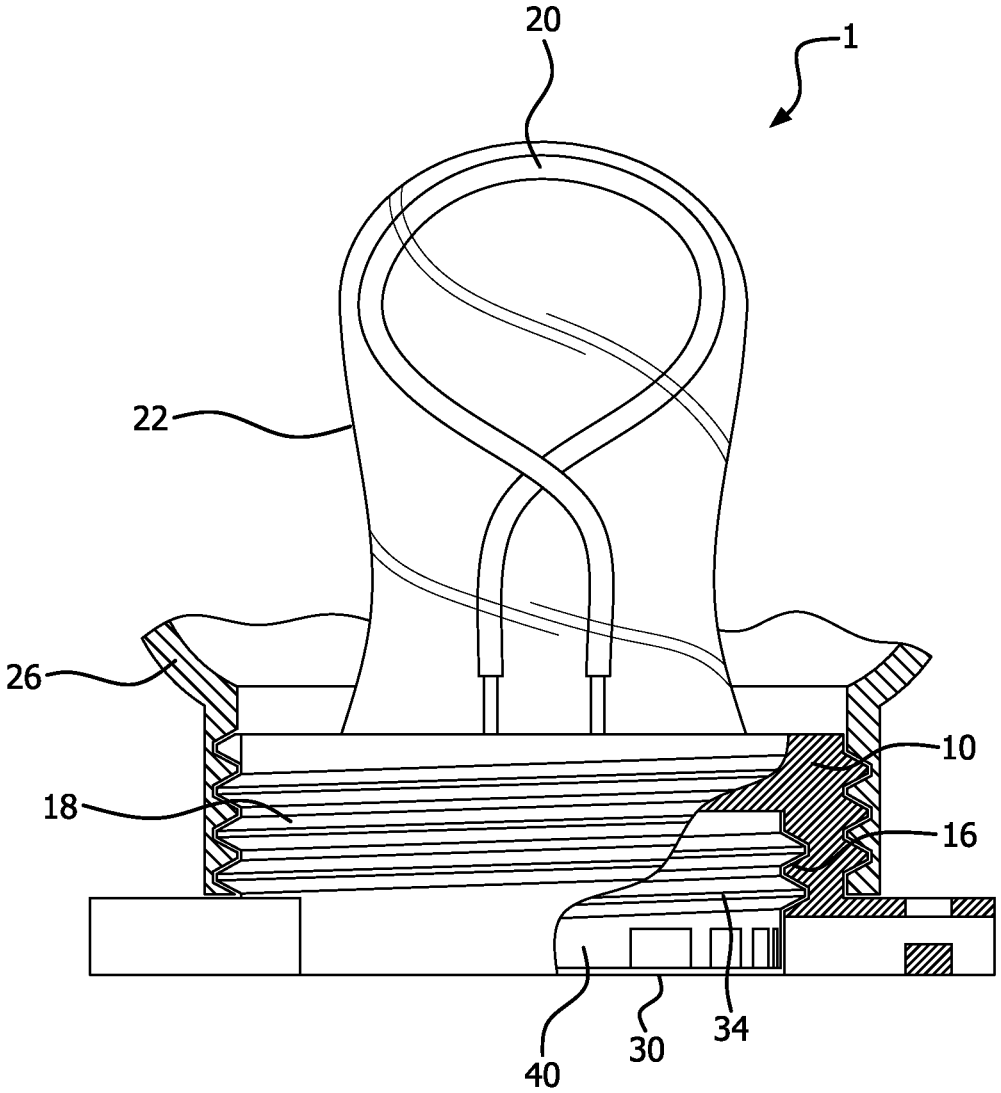
FIG. 3 shows a connection of the heat sink member to the base member of the inner cover of the LED candle flame light of the present invention.
Figure 4:
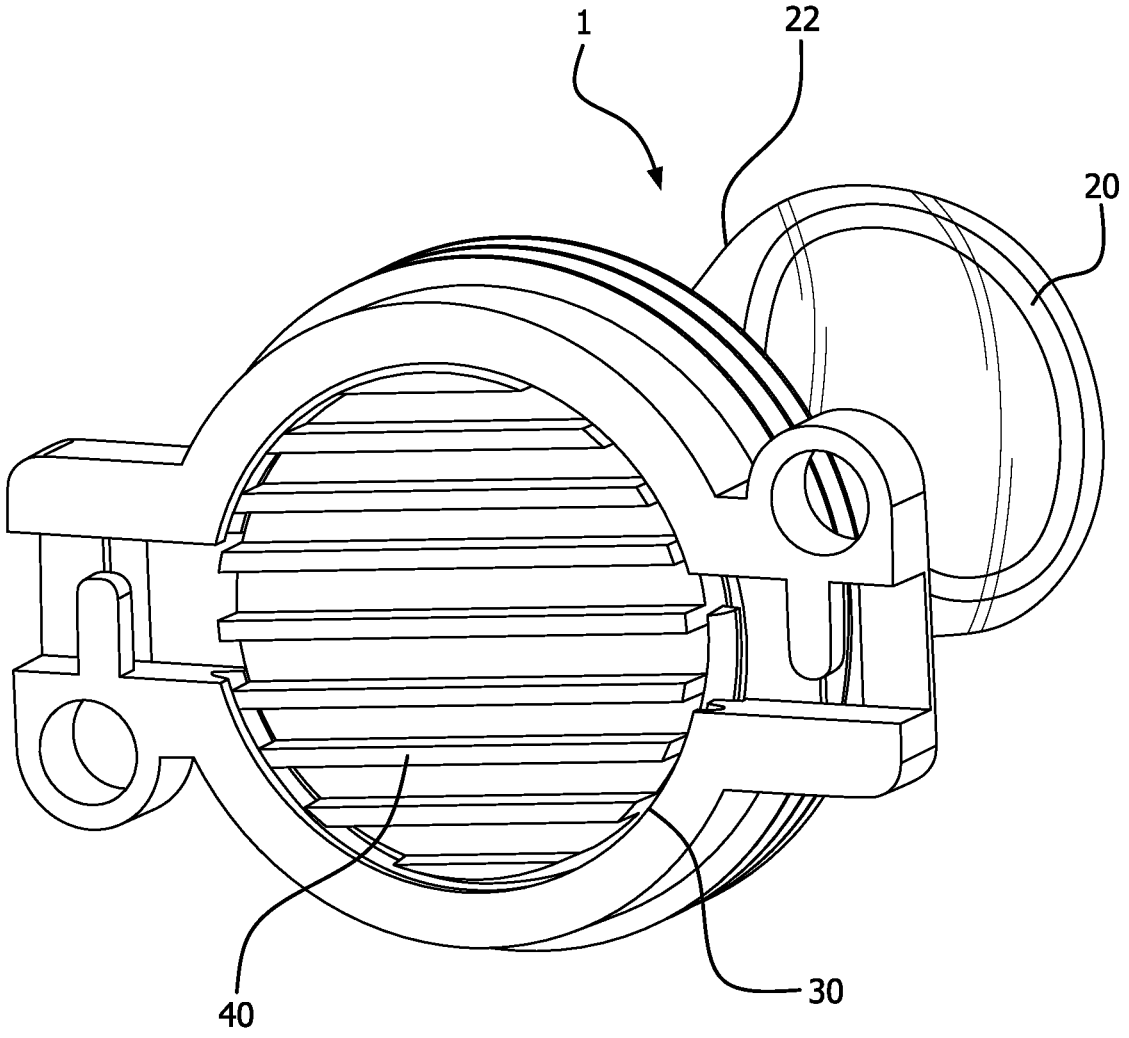
FIG. 4 is a bottom perspective view of the heat sink member attached to the LED candle flame light of the present invention.

Inner transparent cover 22 encloses filament 20. Cover 22 is attached to and extends upward from top surface 4 of base member 2. Advantageously, cover 22 has the same outline shape of filament 20 and is formfitted around the filament so as to closely encase it, as best seen in FIGS. 1-3. Currently filaments, especially in COB LED strip lighting, tend to flex, bend, and generally change into an undesired shape when illuminated. Cover 22 is specifically configured to ensure that filament 20 maintains its non-illuminated shape while the filament and its light 1 are illuminated.

Outer transparent cover 24 encloses and encompasses inner cover 22. Outer cover 24 has bottom base 26 having screw threads 28. Screw threads 18 of base member 2 are configured to threadably engage screw threads 28 of bottom base 26 of outer cover 24. With regard to the connection of base member 2 and bottom base 26, screw threads 18 comprise a first connection means and screw threads 28 comprise a second connection means. It is contemplated that other means of connecting base member 2 of cover 22 and bottom base 26 of cover 24 can be utilized, such as by snap-on attachment tabs inserted into receiving slots.

Heat sink member 30 comprises upper section 32 having screw threads 34 and lower section 36 comprising heat sink component 40 fabricated of heat absorbent material. Heat sink component 34 is configured to absorb heat generated by flame light filament 20. Screw threads 34 of heat sink member 40 threadably engage threads 16 of base member 2 such that upper section 32 of the heat sink member is located within opening 6 of the base member. Heat sink member 30 is then aligned adjacent to base member 2, as seen in FIG. 3.

Figure 5:
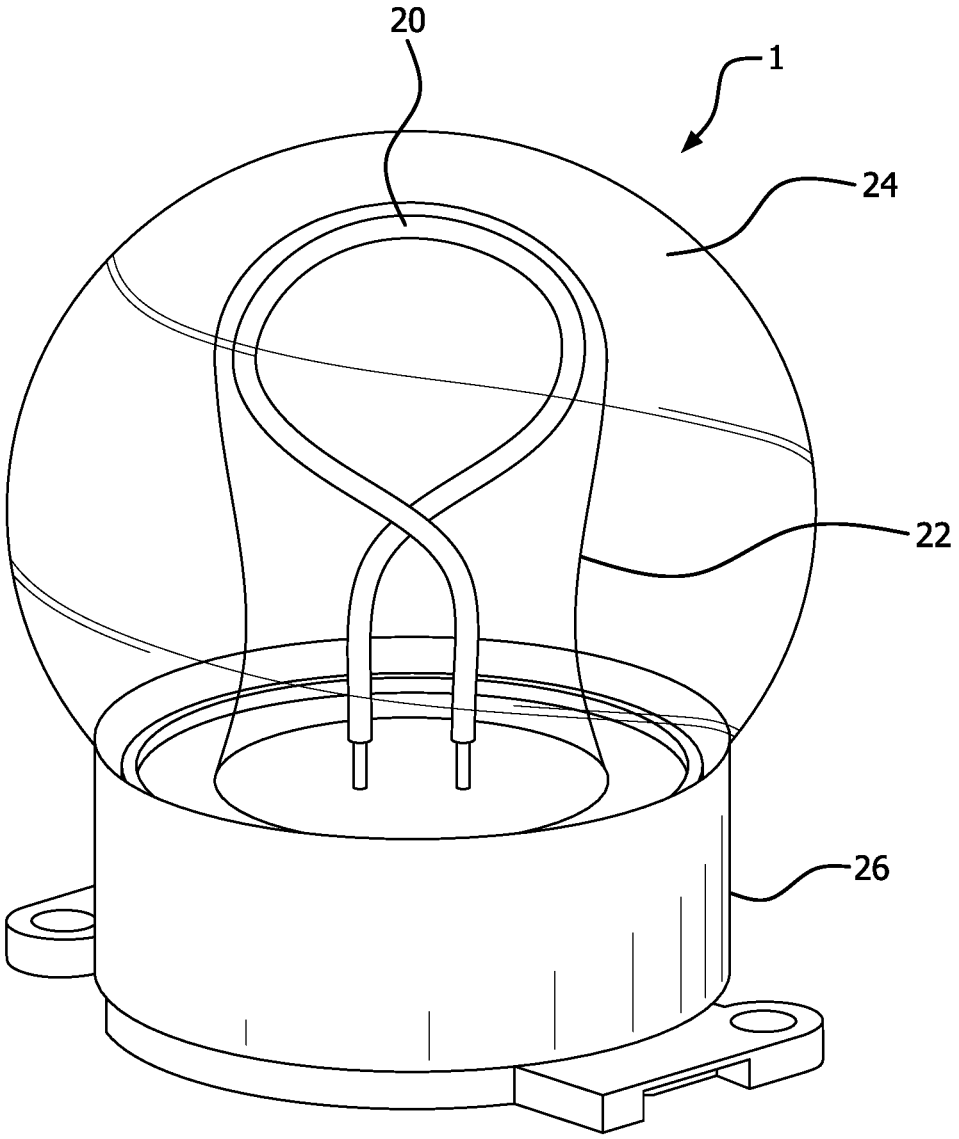
FIG. 5 shows the LED candle flame light of the present invention with a globe shaped outer transparent cover.
Figure 6:
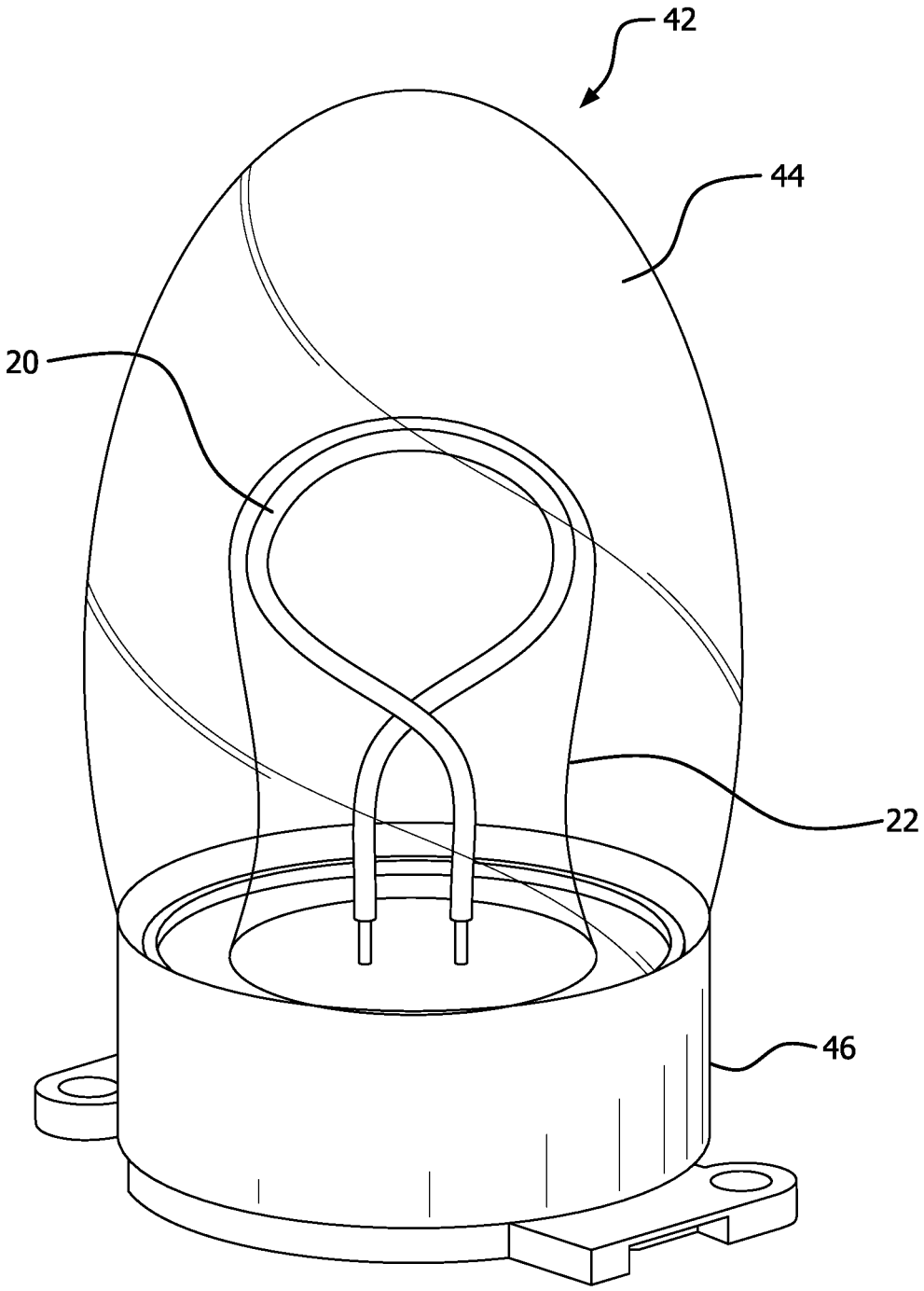
FIG. 6 shows the LED candle flame light of the present invention with an egg shell shaped outer transparent cover.

Outer transparent cover 24 of the present invention can take a variety of different shapes. Outer cover 24 is interchangeable with inner transparent cover 22 and its base member 2 by disengaging threads on bottom base 26 of the outer cover with those of threads 18 of the base member and screwing in the bottom base of another outer cover. For instance, outer cover 24 is globed shaped and is shown in FIGS. 3 and 5 as being threadably engaged by means of its screw threads 28 and threads 18 of base member 2. FIG. 6 is an example of outer cover 44 being egg shell shaped with its bottom base 46 threadably engaged with base member 2. It is contemplated that a variety of differently shaped transparent outer covers can be utilized with a single LED candle flame light inner cover and base member of the present invention. Regardless of the shape of the outer cover, each will provide a measure of protection for filament components 20 if the light is impacted; and will also be available as a safety feature when heat is generated during illumination of the light.

However, heat sink member 30 is configured to absorb and dissipate most of the heat generated by filament 20, thus reducing the heat within inner cover 22. This permits flame 1 to function with higher wattages and thus greater illumination.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. An LED candle flame light comprising:

a base member having a top surface, a through opening extending from the bottom of the base member to the top surface, a sidewall circumscribing the opening;

an LED candle flame light filament having a non-illuminated shape extending upwardly from the top surface of the base member;

an inner transparent cover encasing the filament, said cover attached to and extending upward from the top surface of the base member, having the same outline shape of the filament, and being formfitted around the filament, wherein when the filament is illuminated, the cover maintains its non-illuminated shape;

an outer transparent cover enclosing the inner cover, said outer cover having a bottom base; and the inner cover having first connection means for engaging second connection means on the outer cover, the first and second connection means attaching the base member of the inner cover to the bottom base of the outer cover, wherein the outer cover is removable from the inner cover.

2. The LED candle flame light as in claim 1 wherein the outer cover is globe shaped.

3. The LED candle flame light as in claim 1 wherein the outer cover is egg shell shaped.

4. The LED candle flame light as in claim 1 wherein the outer cover is removable from and interchangeable with a variety of differently shaped transparent covers.

5. The LED candle flame light as in claim 1 wherein the first connection means comprises a first set of screw threads and the second connection means comprise a second set of screw threads.

6. The LED candle flame light as in claim 1, wherein the base member has a set of screw threads, the candle flame light further comprising a heat sink member, said heat sink member comprising an upper section having screw threads and a lower section comprising a heat sink component fabricated of heat absorption material, the heat sink component being configured to absorb heat generated by voltage from the filament, wherein the screw threads of the heat sink member is configured to threadably engage the screw threads of the base member, such that the upper section of the heat sink member is located within the base member and the heat sink member is adjacent to the base member.

7. The LED candle flame light as in claim 6 wherein the heat sink component is aluminum.

8. The LED candle flame light as in claim 6 wherein the outer cover is globe shaped.

9. The LED candle flame light as in claim 6 wherein the outer cover is shell shaped.

10. The LED candle flame light as in claim 6 wherein the outer cover is removable from and interchangeable with a variety of differently shaped transparent covers.

* * * * *